US005211543A

United States Patent [19]

Siebenwurst et al.

[11] Patent Number: 5,211,543

[45] Date of Patent: May 18, 1993

[54] LIQUID-RING PUMP WITH PRESSURE CHAMBER VALVE PLATE

[75] Inventors: Robert Siebenwurst, Nürnberg; Peter Trimborn, Feucht, both of Fed. Rep. of Germany

[73] Assignee: Siemens Aktiengesellschaft, Munich, Fed. Rep. of Germany

[21] Appl. No.: 865,997

[22] Filed: Apr. 9, 1992

[30] Foreign Application Priority Data

May 17, 1991 [DE] Fed. Rep. of Germany ... 9106151[U]

[51] Int. Cl.[5] ..... F04C 19/00

[52] U.S. Cl. ..... 417/68

[58] Field of Search ..... 417/68, 69

[56] References Cited

U.S. PATENT DOCUMENTS 3,366,314 1/1968 Schroeder ..... 417/68

FOREIGN PATENT DOCUMENTS 2064002 6/1981 United Kingdom ..... 417/68

*Primary Examiner*—Richard A. Bertsch
*Assistant Examiner*—Roland McAndrews
*Attorney, Agent, or Firm*—Kenyon & Kenyon

[57] ABSTRACT

The present invention relates a liquid-ring pump, in which the impeller (5) of the pump is rotatably arranged in the pump chamber formed by the pump housing (2), and the pump chamber is closed off by a disk cam 6 which has at least one inlet slit (8) and several output ports (10). Arranged between the disk cam (6) and a side shield (1) covering this disk cam is a suction chamber (7), connected to the inlet slit (8), and a pressure chamber (9), connected to the output ports. At least one of the output ports (10) is covered by a valve plate which may be moved away from this output port and be supported on a collector plate (12) affixed to the housing. The assembly of the valve plate is facilitated in that the collector plate (12) is connected to the side shield (1), and the valve plate (11) is guided by guide elements (14) penetrating through corresponding openings (15) in the valve plate (11), which openings are arranged between the collector plate (12) and the disk cam (6).

24 Claims, 3 Drawing Sheets

LIQUID-RING PUMP WITH PRESSURE CHAMBER VALVE PLATE

BACKGROUND OF THE INVENTION

The present invention relates to a liquid-ring pump and more specifically to a liquid-ring pump having an impeller rotatably accommodated in its pump chamber. The pump chamber is formed by the pump's housing and is closed off by a disk cam showing an inlet slit and several output ports. The disk cam is covered by a slide shield configured on the pump housing. Arranged between the slide shield and the disk cam is a suction chamber connected to the inlet slit and a pressure chamber connected to the output ports.

The German Printed Patent 27 04 863 discloses a liquid-ring pump. In this pump, valve plates and collector plates are arranged and secured on the disk cam. This construction increases assembly expenditure. Furthermore, if the valve plate is destroyed or worn out during later pump operation, the side shield must be disassembled when replacing the valve plate.

The present invention discloses a generic type of liquid-ring pump in which installing the valve plate in front of the output ports is considerably easier than in conventional liquid-ring pumps.

SUMMARY OF THE INVENTION

The present invention achieves this improved arrangement by having the collector plate connected to the side shield, and having the valve plate guided by guide elements penetrating through openings in the valve plate which are arranged between the collector plate and the disk cam. Specially assembling the collector plate on the disk cam is no longer necessary because the collector plate is connected to the side shield. The valve plate only needs to be slipped on to the guide elements. Since the valve plate is no longer clamped on one side, it can lift up from all the output ports by the same distance, so that the gas is not hindered from escaping out of the output ports.

Another way to facilitate the pump assembly of the present invention is to premold the collector plate in one piece on the side shield.

In another embodiment, the collector plate is provided on a sealing plate so that exchanging a defective valve plate or controlling its operativeness without disassembling larger pump parts is possible. This sealing plate is used to cover an inspection opening provided in the side shield.

The valve plate can be mounted on the guide elements before the side shield or the sealing plate is assembled since pins or bushings are provided as guide elements. These guide elements mate with corresponding location holes on the collector plate and/or on the disk cam. Another way to facilitate the assembly of the present invention is to secure the pins or bushings in the location holes of the collector plate or of the disk cam.

The present invention will be clarified in greater detail in the following on the basis of an exemplified embodiment depicted in the drawing.

DETAILED DESCRIPTION

Figure 1:
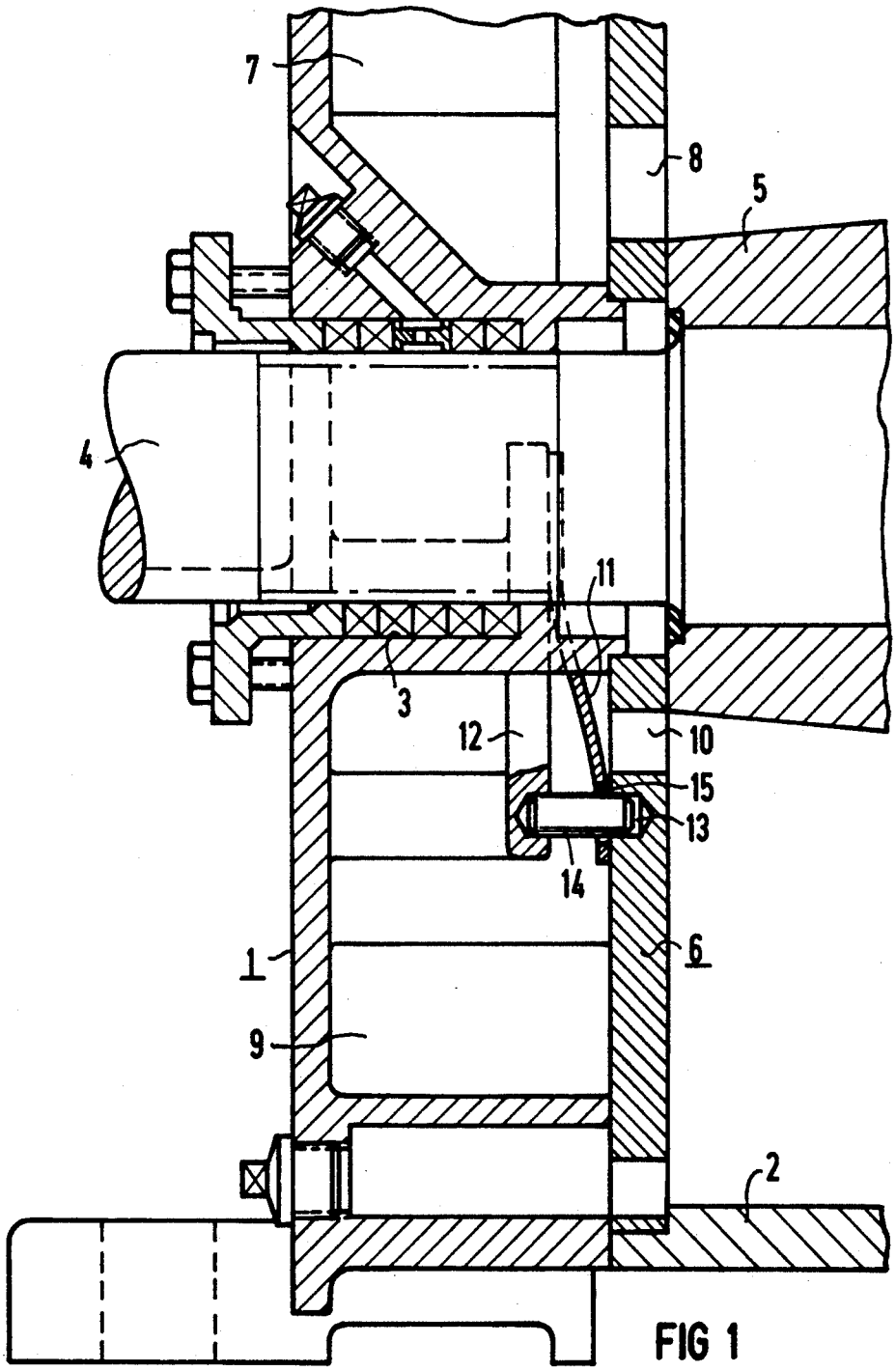
FIG. 1 is a partial-sectional view of a liquid-ring pump, in which a collector plate is premolded on the side shield according to an embodiment of the present invention.

Element 1 denotes a side shield which is installed on the pump housing 2 of a liquid-ring pump. This side shield 1 has a shaft bore hole 3, through which the shaft 4 of the pump's impeller 5 is sealingly accommodated. A disk cam 6, which occludes the pump chamber at the front end, is arranged between the side shield 1 and the pump housing 2. This disk cam 6 has at least one inlet slit 8, providing an opening to the suction chamber 7 of the side shield 1. The disk cam 6 also has several output ports 10, which provide an opening to the pressure chamber 9 of the side shield 1. Only one of the output ports 10 is depicted in the drawings. The area of the disk cam 6 provided with the output ports 10 is shown rotated in the drawing plane.

Assigned to each of the output ports 10 is a valve plate 11, which either clears or covers the output ports 10 based on prevailing operating conditions. A collector plate 12, premolded on the side shield 1, is allocated to the valve plate 11. Pins or bushings 14 are inserted with their ends in mutually opposing location holes 13 provided on the collector plate 12 and on the disk cam 6. The pins or bushings 14 penetrate through guide openings 15 existing on the valve plate 11. As a result, the valve plate 11 is secured in terms of position opposite the output ports 10. Axially shifting the valve plate 11 about the pins or bushings 14 in the area between the disk cam 6 and the collector plate 12 is possible. The axial shifting of the valve plate 11 causes the output ports 10 to open or close based on the displacement direction.

Individual output ports 10 or all of the output ports 10 are closed or opened based on prevailing pressure conditions.

Figure 2:
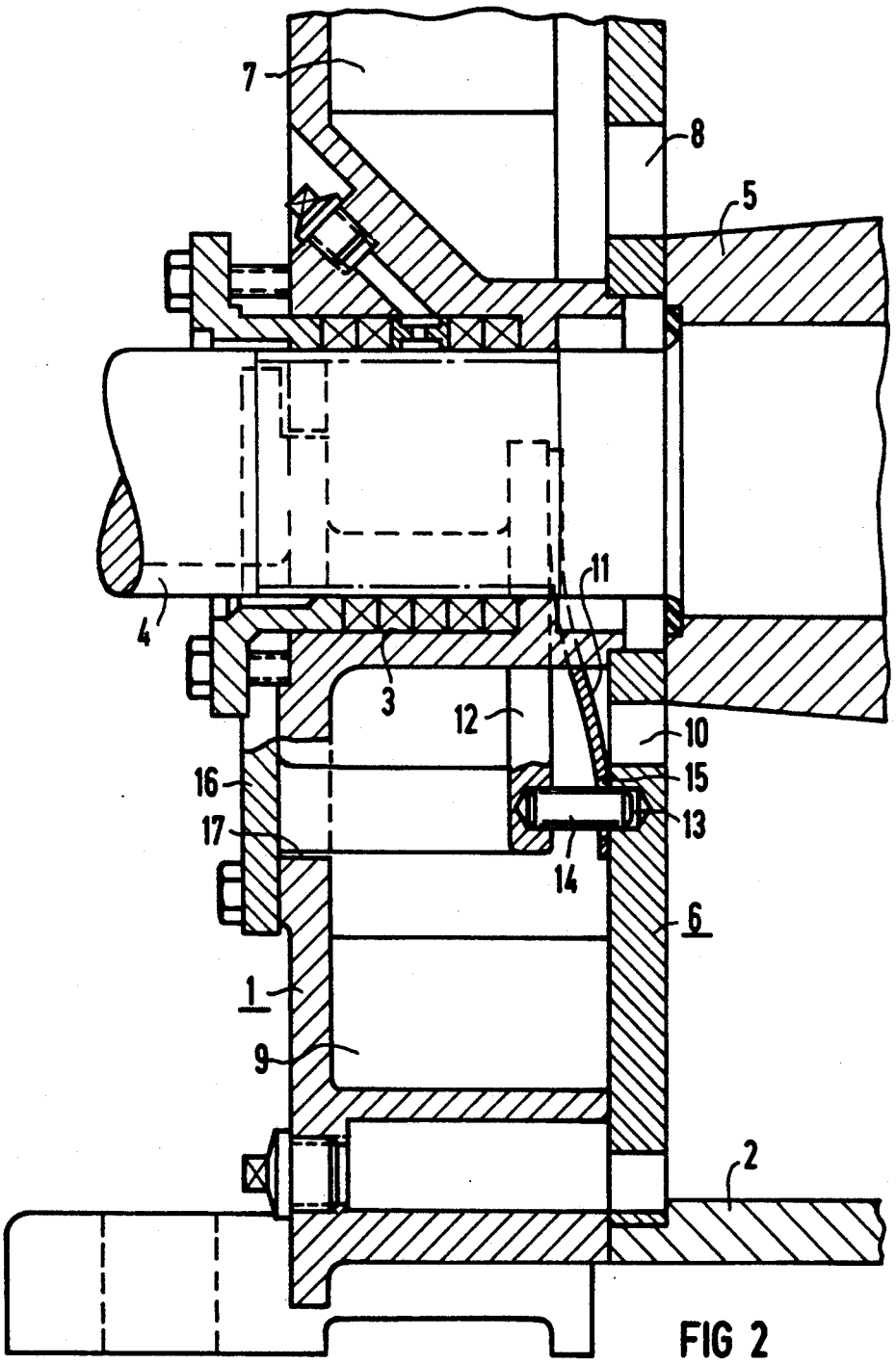
FIG. 2 is a partial-sectional view of a liquid-ring pump, in which the collector plate is configured on a sealing plate, capable of being attached to the side shield according to another embodiment of the present invention.

FIG. 2 depicts another embodiment of the present invention of a liquid-ring pump, where the collector plate 12 is provided on a sealing plate 16, which serves to close an inspection opening 17 in the side shield 1. After this sealing plate 16 is removed, the valve plate 11 can be controlled or even replaced when damaged.

Figure 3:
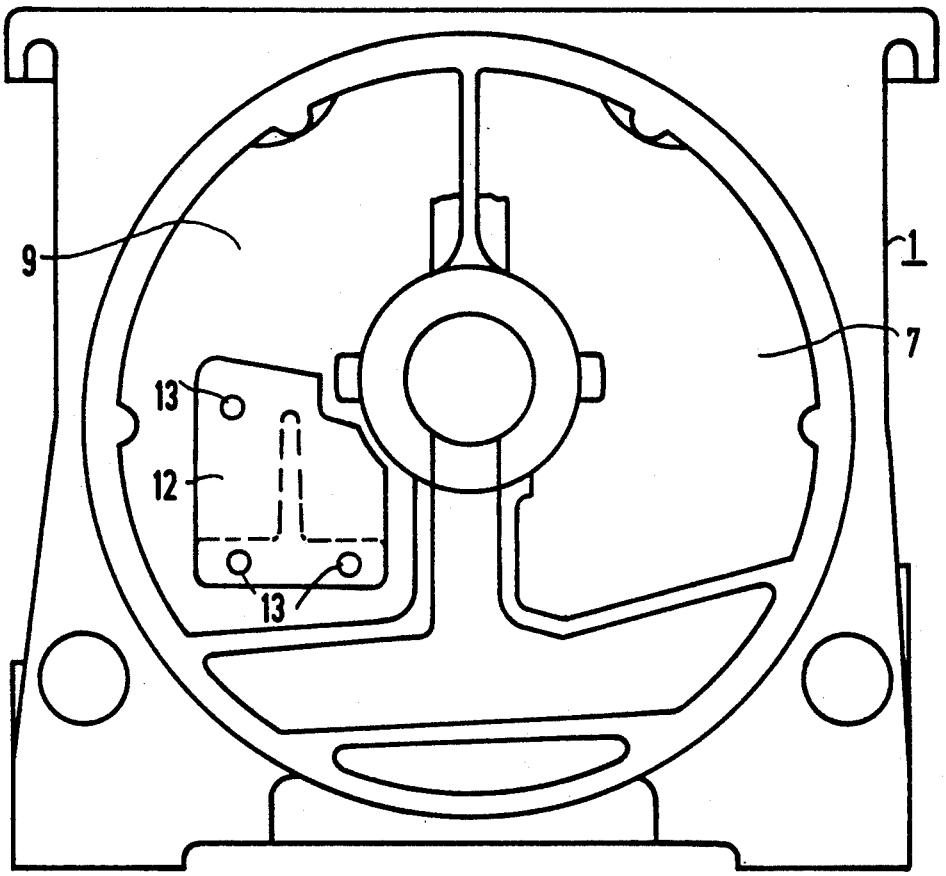
FIG. 3 is a top view of a side shield with a premolded collector plate.

As is clear from FIG. 3, several location holes 13, set apart from one another, are provided on the collector plate 12 and corresponding holes are provided on the disk cam 6. As a result of this spread-out arrangement of the location holes 13, the valve plate 11 is properly guided by the pins or bushings 14 inserted in these location holes.

The pins or bushings 14 can either be secured in the location holes 13 of the disk cam 6 or in the location holes 13 of the collector plate 12. The valve plate 11 with its guide openings 15 is mounted on these secured pins or bushings 14. When the side shield 1 or the sealing plate 16 is installed, the pins or bushings 14 then mate with the opposite location holes 13 of the collector plate 12 or of the disk cam 6. Thus, the valve plate 11 is completely secured.

What is claimed is:

1. A liquid-ring pump having a chamber formed by the pump housing, rotatably accommodating an impeller, and closed off at least no one front end by a disk cam 6 and being covered by a side shield, said disk cam having at least one inlet slit and several output ports, and said side shield being configured on the pump housing, and forming a suction chamber between it and the disk cam such that the inlet slit provides an opening to the suction chamber and forming a pressure chamber such that the output ports provide an opening to the pressure chamber, at least one of the output ports being covered by at least one valve plate which can be moved away from the at least one of the output ports and be supported on a collector plate affixed to the housing, wherein the collector plate is connected to the side shield, and wherein guide elements arranged between the collector plate and the disk cam guide the valve plate via corresponding openings in the valve plate.

2. The liquid-ring pump according to claim 1, wherein the collector plate is premolded in one piece on the side shield.

3. The liquid-ring pump according to claim 2, wherein pin or bushings are provided as the guide elements, which mate with corresponding location holes provided on the collector plate and/or on the disk cam.

4. The liquid-ring pump according to claim 3, wherein the pins or bushings are secured in the location holes of the collector plate.

5. The liquid-ring pump according to claim 3, wherein the pins or bushings are secured in the location holes of the disk cam.

6. The liquid-ring pump according to claim 2, wherein pins or bushings are provided as the guide elements, which mate with corresponding location holes provided on the collector plate.

7. The liquid-ring pump according to claim 6, wherein the pins or bushings are secured in the location holes of the collector plate.

8. The liquid-ring pump according to claim 2, wherein pins or bushings are provided as the guide elements, which mate with corresponding location holes provided on the disk cam.

9. The liquid-ring pump according to claim 8, wherein the pins or bushings are secured in the location holes of the disk cam.

10. The liquid-ring pump according to claim 1, wherein the collector plate is configured on a sealing plate, which covers an inspection opening provided in the side shield.

11. The liquid-ring pump according to claim 10, wherein pins or bushings are provided as the guide elements, which mate with corresponding location holes provided on the collector plate and/or on the disk cam.

12. The liquid-ring pump according to claim 11, wherein the pins or bushings are secured in the location holes of the collector plate.

13. The liquid-ring pump according to claim 11, wherein the pins or bushings are secured in the location holes of the disk cam.

14. The liquid-ring pump according to claim 10, wherein pins or bushings are provided as the guide elements, which mate with corresponding location holes provided on the collector plate.

15. The liquid-ring pump according to claim 14, wherein the pins or bushings are secured in the location holes of the collector plate.

16. The liquid-ring pump according to claim 10, wherein pins or bushings are provided as the guide elements, which mate with corresponding location holes provided on the disk cam.

17. The liquid-ring pump according to claim 16, wherein the pins or bushings are secured in the location holes of the disk cam.

18. The liquid-ring pump according to claim 1, wherein pins or bushings are provided as the guide elements, which mate with corresponding location holes provided on the collector plate and/or on the disk cam.

19. The liquid-ring pump according to claim 18, wherein the pins or bushings are secured in the location holes of the collector plate.

20. The liquid-ring pump according to claim 18, wherein the pins or bushings are secured in the location holes of the disk cam.

21. The liquid-ring pump according to claim 1, wherein pins or bushings are provided as the guide elements, which mate with corresponding location holes provided on the collector plate.

22. The liquid-ring pump according to claim 21, wherein the pins or bushings are secured in the location holes of the collector plate.

23. The liquid-ring pump according to claim 1, wherein pins or bushings are provided as the guide elements, which mate with corresponding location holes provided on the disk cam.

24. The liquid-ring pump according to claim 23, wherein the pins or bushings are secured in the location holes of the disk cam.

* * * * *